US005587718A

United States Patent [19]

Iardella et al.

[11] Patent Number: 5,587,718

[45] Date of Patent: Dec. 24, 1996

[54] METHOD FOR DISCOVERING AND DESIGNATING AIR TARGETS

[75] Inventors: Carlo A. Iardella, Carrara; Mauro Agrusa, La Spezia, both of Italy

[73] Assignee: GF-OTO Melara Breda Bresciana S.r.l., Rome, Italy

[21] Appl. No.: 260,817

[22] Filed: Jun. 16, 1994

[30] Foreign Application Priority Data

Jun. 16, 1993 [IT] Italy ..... MI93A1290

[51] Int. Cl.[6] ..... G01S 5/04; F41G 5/12

[52] U.S. Cl. ..... 342/443; 89/41.08

[58] Field of Search ..... 342/357, 443, 342/56, 57, 58, 67; 364/423; 89/41.08, 41.07

[56] References Cited

U.S. PATENT DOCUMENTS

| | | | |
|---|---|---|---|
| 3,573,823 | 4/1971 | French | 342/43 |
| 3,614,723 | 10/1971 | Hermes et al. | 89/41.08 |
| 3,824,699 | 7/1974 | Lenz et al. | 33/334 |
| 3,846,797 | 11/1974 | Brown et al. | 342/45 |
| 4,692,763 | 9/1987 | Gregg, Jr. | 342/28 |
| 4,713,669 | 12/1987 | Shuch | 342/455 |
| 4,741,245 | 5/1988 | Malone | 89/41.03 |
| 4,967,641 | 11/1990 | Chambre | 89/41.08 |
| 5,334,987 | 8/1994 | Teach | 342/357 |

FOREIGN PATENT DOCUMENTS

| | | | |
|---|---|---|---|
| 0117813 | 9/1984 | European Pat. Off. | G01S 7/44 |
| 0359950 | 3/1990 | European Pat. Off. | F41G 3/04 |
| 2415285 | 8/1979 | France | F42G 3/00 |
| 2670037 | 6/1992 | France | G06F 15/50 |
| WO8802841 | 4/1988 | WIPO | F41G 5/08 |

*Primary Examiner*—Gregory C. Issing
*Attorney, Agent, or Firm*—Cushman Darby & Cushman, L.L.P.

[57] ABSTRACT

An automatic apparatus and relevant method for discovering and designating air targets constituted by a transmitter assembly which can be associated with a radar and connected via radio with a portable receiver assembly. The portable receiver assembly is further constituted by a headset unit, an auxiliary terminal and a receiver unit with a satellite system and data processing electronics.

The headset unit includes an earphone and a Magnetic North sensor and is connected with the receiver unit. The portable receiver assembly can orient an operator, by means of audio signals, towards the direction of provenance of a selected target and supply her/him with information relevant to the target by means of sound messages, e.g., digitalized voice.

2 Claims, 3 Drawing Sheets

METHOD FOR DISCOVERING AND DESIGNATING AIR TARGETS

BACKGROUND OF THE INVENTION

The present invention relates to a method for discovering and designating air targets.

Modern combats are characterized above all by a high mobility and a large dispersion of units on battle field. As a consequence, the anti-aircraft systems are required to secure, or meet, determined requisites, such as, e.g., minimal values of reaction time, action starting time and intervention time. The same systems must simultaneously achieve the highest levels of precision and degree effectiveness.

Furthermore, the possibility of frequently modifying the deployment without discontinuing the system operativeness must be provided.

All the above can only be secured by those systems which are capable of automatically solving, within reduced times and with the required precision level, the problems of position determining and direction orienting.

The apparatuses which are known from the prior art and are presently used to constitute such systems, compute and process the received data, in an autonomous mode. The results of these analyses are ususally reported in alphanumerical mode and are then either displayed on suitable displays, or printed. Inasmuch as such results are not always end values, they require the operator to perform data and cartographic analyses, with consequent time losses.

SUMMARY OF THE INVENTION

The novel method according to the present invention aims hence at solving these drawbacks, by supplying the operator with an immediate answer, or information data, without the operator needing to perform any further analyses of the received data.

A purpose of the present invention is of providing a method which is capable of receiving a data string from an external source and reporting to the operator the same data, or the apparatus operating status, by voice.

Another purpose of the method is of enabling the position to be determined without the aid of cartographic procedures and known points. It furthermore should be capable of supplying the operator with orienting data referred to a precise reference direction.

The method must furthermore be capable of determining, by using suitable algorithms, the most dangerous menace and hence commanding, by means of audio signals, the operator orienting towards the direction where the selected target is.

Another purpose is of supplying the operator with distance information and other characteristics of the selected target, by sound messages, including real-time updating of the information as to any meaningful changes which may have occurred.

Not the last, and not the least purpose of the present invention is the configuration of apparatus, which must be such as to secure simplicity in use and in servicing the single parts, or devices. Furthermore, the apparatus should have as small overall dimensions and total weight, as possible.

In order to achieve these purposes, an automatic apparatus for discovering and designating air targets is disclosed, which is constituted by a transmitter assembly which can be associated with a radar and can be connected, via radio, with a portable receiver assembly, which is furthermore constituted by a headset unit, an auxiliary terminal and a receiver unit with a satellite system and a data processing electronics, with the headset unit comprising an earphone and a Magnetic North sensor, being suitable for being connected with the receiver unit, the receiver unit and the headset unit being suitable for orienting an operator, by means of audio signals, towards the direction of provenance of a selected target, and supplying her/him with information relevant to the same target, by means of sound messages.

BRIEF DESCRIPTION OF THE DRAWINGS

The characteristcs and the advantages of the method according to the present invention will be better understood from the following exemplifying, non-limitative disclosure in detail thereof, made by referring to the accompanying drawings, in which.

DETAILED DESCRIPTION

Figure 1:
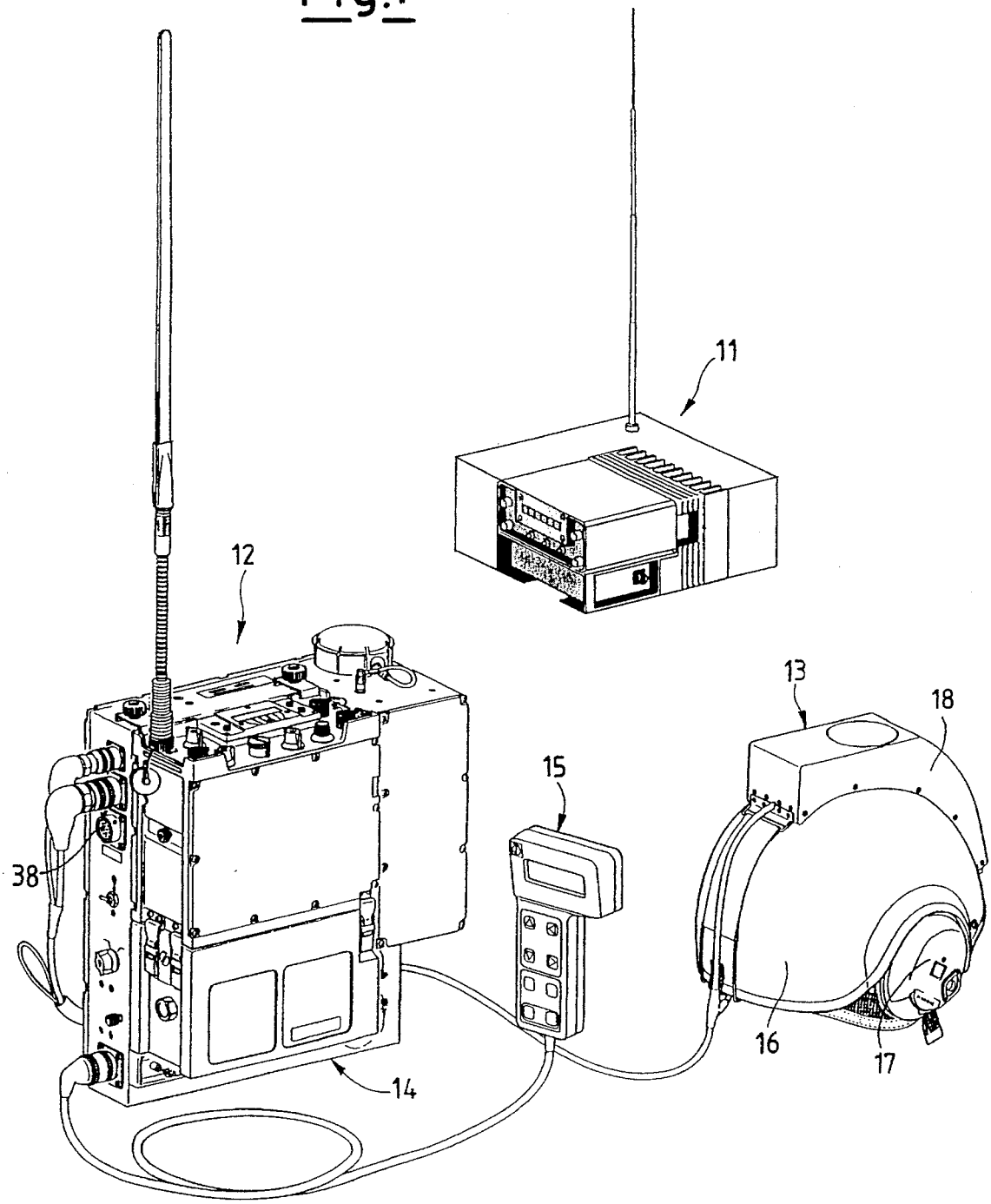
FIG. 1 is a perspective view of an automatic apparatus for discovering and designating air targets, according to a preferred practice of the method of the present invention.

Referring to FIG. 1, an automatic apparatus for discovering and designating air targets is shown, which is essentially composed by a transmitter assembly 11 and a portable receiver assembly 12. The transmitter assembly 11 is usually sited at a radar watching system and is connected, via radio, with the portable receiver assembly 12.

The receiver assembly 12 is constituted by a headset unit 13, a receiver unit 14 and an auxiliary terminal 15.

The transmitter assembly 11, which receives from discovery radar the information about the air menace, transmits then the data relating to the targets, e.g., within the VHF band, to the receiver assembly 12.

The headset unit 13, which is composed by a headset 16, and an earphone 17, with which a live-voice device and a Magnetic North sensor 18 can be associated, supplies the operator with the angular divergence of her/his sight line from the Magnetic North, and, furthermore, by means of its earphones 17, transmits the audio signals and the sound messages relevant to the direction of provenance and the characteristics of the menace.

The receiver unit 14 is essentially subdivided into three modules, i.e., a base support, a radio module and a supply module. In the base support, several main modules and sensors are installed, such as a data module, a data processing electronic system and a G.P.S. satellite system.

The apparatus, i.e., the receiver assembly 12 is furthermore provided with an auxiliary terminal 15, and with an auxiliary connector 38, which can be connected with a computer in order to enable the operating scenario to be reproduced and all of the characteristics of the targets and apparatus status to be monitored.

The auxiliary terminal 15 supplies the operator with various auxiliary information relevant to targets, terrain and selected weapon. It furthermore makes it possible for the audio signals from the earphone to be regulated, or signals or displays the main failures or operating conditions.

In any case, it performs a secondary task, and the use thereof is not necessary for the remaining portion of the apparatus to operate correctly and, however, in no way does it change the characteristics thereof.

Figure 2:
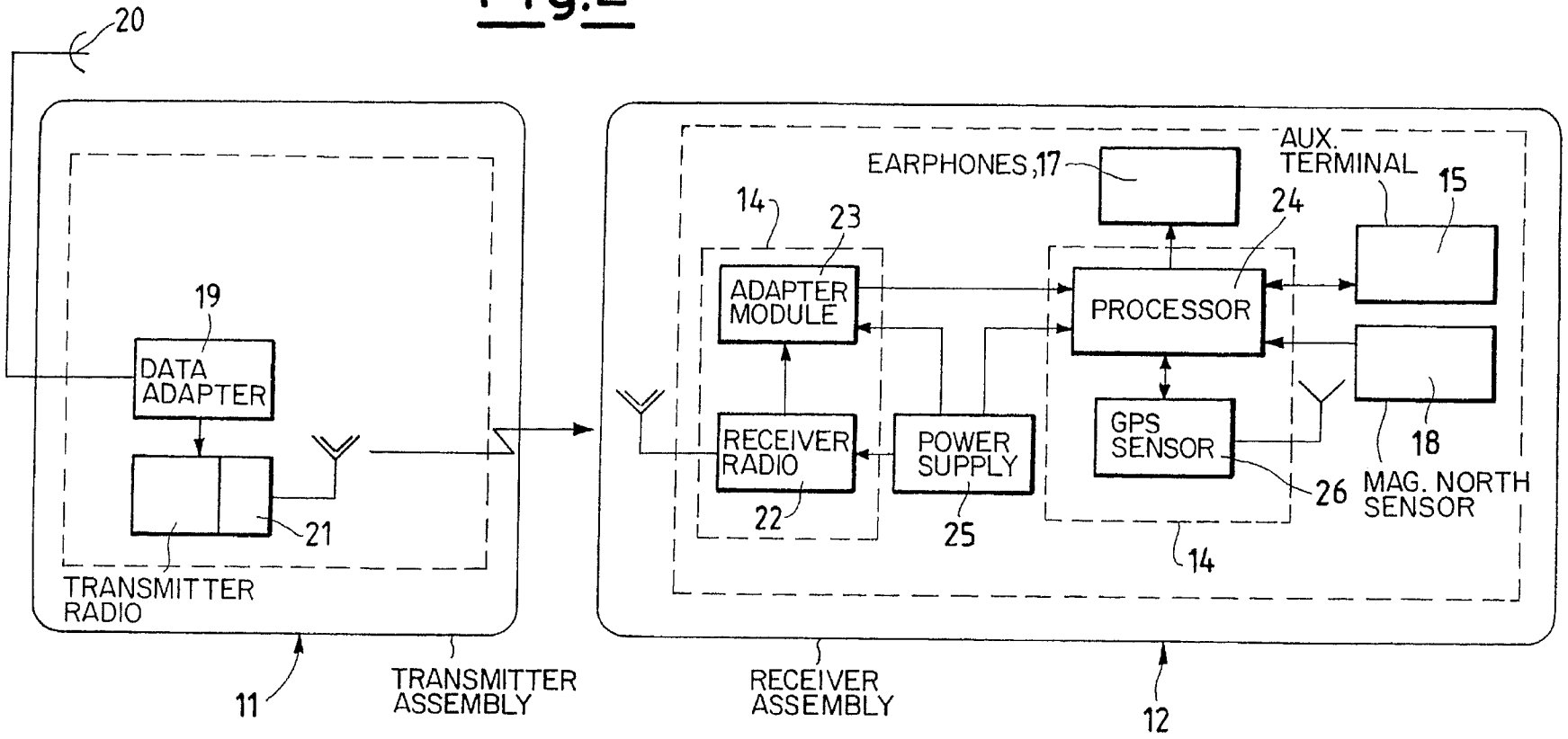
FIG. 2 is a block diagram of the apparatus of FIG. 1.

In FIG. 2, the main block diagram of the apparatus according to the present invention is displayed.

As one may see from this Figure, a first data adapter module 19, incorporated into the transmitter assembly 11, is connected with the discovery radar 20, from which it receives signals, i.e., the data relevant to targets. The same adapter module 19 is also connected with a transmitter radio Tx 21, which transmits such data to the receiver radio Rx 22 of the receiver unit 14, i.e., installed in the receiver assembly 12.

The radio set Rx 22 is connected, in its turn, with a second adapter module 23, which sends the received data to a processor 24. Furthermore, a power supply module 25 is provided in order to feed both the processor 24 and the module 23 and radio set Rx 22, and therefore turn the receiver assembly 12 into a standalone one.

The processor 24 communicates with a G.P.S. satellite sensor 26 which, by exploiting a satellite constellation, communicates to the same processor the current position on terrain. Furthermore, the processor 24 receives further data relevant to the angular position on terrain from the Magnetic North sensor 18, which is capable of supplying an angular position information referred to Magnetic North.

The received and processed data is then transmitted to earphones 17 and auxiliary terminal 15.

The apparatus is provided with an acoustical interface, so all main information data is sent to the operator by means of audio signals and messages. For example, a digitalized voice reproduces the transmitted information by means of the radio connection, whilst modulated sounds keep the operator informed on the apparatus operating status and orient her/him towards the target provenance direction.

Figure 3:
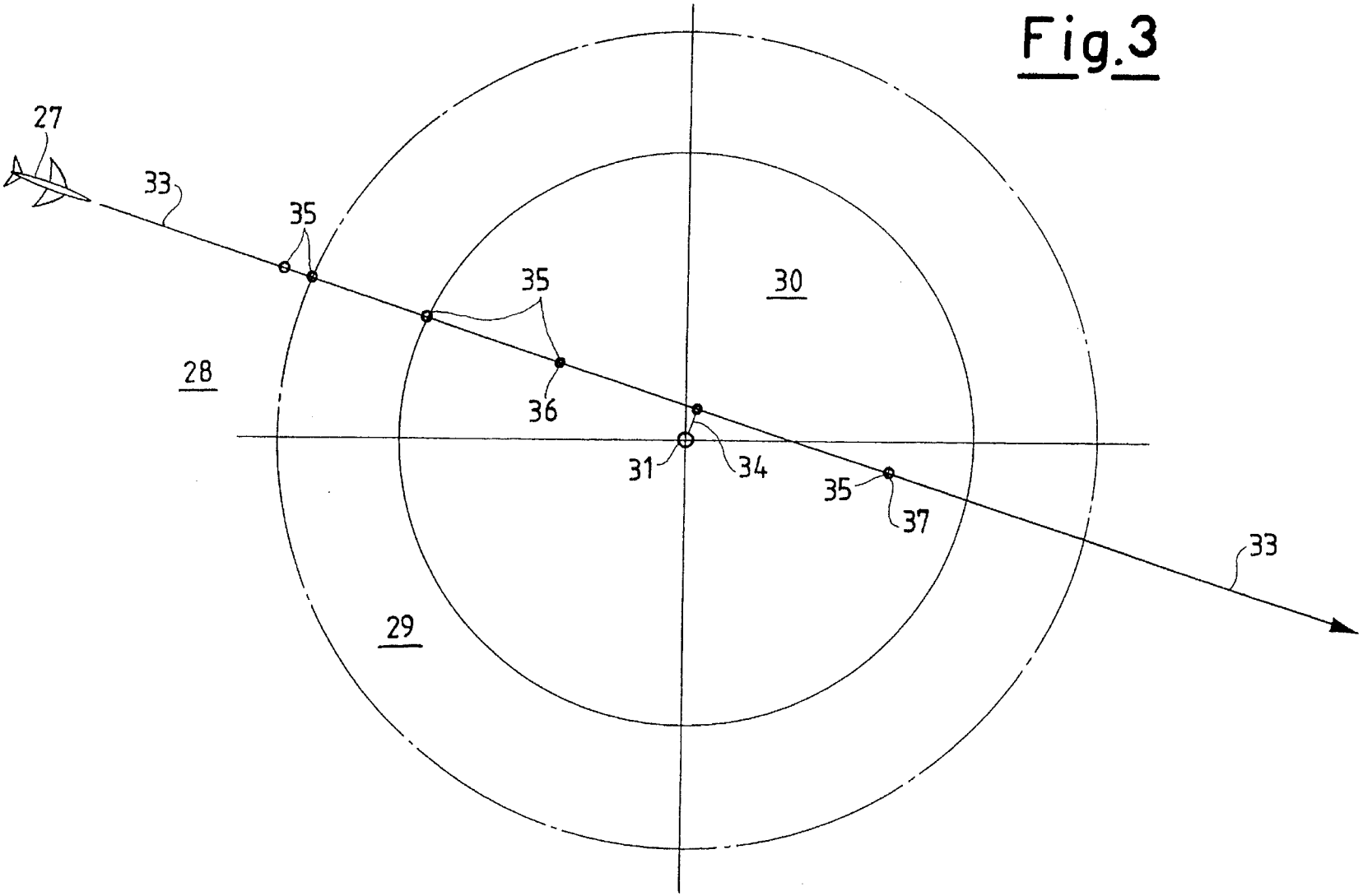
FIG. 3 is a schematic illustration relevant to the operating method of the same apparatus.

As one can see from FIG. 3, the apparatus detects the position of the target 27 as referred to two zones, one of which is a discovery zone 29, and the other of which is an engagement zone 30. On the contrary, all targets which are in an external zone 28 are located by the radar, but their presence is ignored until they enter the discovery zone 29.

In fact, if the target 27 is inside the discovery zone 29, the operator 31 is kept informed on the operating configuration and on the targets characteristics by sound messages.

A first message relates the alarm status and defines the operating conditions of battle units. For example, the operator is informed whether the attack is an imminent attack, a probable attack, or the attack does not exist, and furthermore is informed whether it is only a matter of drill.

A second message relates to the identification of the menace and informs the operator whether the discovered aircraft or helicopter is a friendly or an enemy one.

A further communication relates to the weapon control command and therefore defines whether fire must be free, conditioned, or forbidden.

These messages are supplied once only and are only repeated when changes in conditions occur.

The operator receives an indication as to the type of trajectory 33 which the target 27 is being running along. The value in meters is the distance 34 which the target will have from the operator 31 when it will be abeam of her/him. This indication is supplied once for each target, and every time when the distance data changes.

A distance data relates to a distance 35 of the target. The message is reported with kilometric variation, with a minimal time interval between the end of the message and the beginning of another. When the minimal time interval between both messages is exceeded, and no variations occur in data, the message is repeated.

When the menacing target enter the engagement zone 30, the operator 31 automatically receives an audio signal from her/his earphone 17. This is a stereo signal which is released on the right hand side or on the left hand side, thus indicating the rotation direction for the operator to orient towards the target. For an angle of 180°, i.e., from +90° to −90°, relatively to the direction of provenance of the target, the signal is modulated in frequency and amplitude, which decrease as the operator approaches the target provenance direction. A signal absence means that the operator is exactly oriented in the direction of provenance of the selected target, and that the angle between her/his orientation line and an aircraft 27 provenance direction line[33] is of zero degree. For angle values outside of the angle of 180°, i.e., of ±90°, the signal reaches its saturation at its highest values.

When the absence of audio signal is reached, acoustical messages are sent, which bear information relevant to the engaged target.

To the operator, a residual time is signalled, which is the residual time remaining for the operator to start the fire action. Such a time also takes into account the flight time of the projectile used, and therefore is released when the target distance is shorter than weapon range, as indicated with the reference numeral 36. The same data is associated with the distance data 35 and is repeated under the same conditions.

When the selected target is outside of the weapon range, in the moving away direction, e.g., in the point indicated with the reference numeral 37, the operator receives an acoustical out-of-range message.

If the apparatus finds, inside the interior of the engagement zone 30, a target which it considers to have higher priority than the selected target, the apparatus with indicate these new conditions to the operator. In the case when the operator selects the second target, with said selection taking place by means of one single operator's head movement, the apparatus will communicate to the operator that it has ackowledged her/his will. This information is followed by a new audio position correction signal.

In all cases, due to the Magnetic North sensor 18 incorporated to the headset 16 of the operator, and aligned with her/his sight line, the position correction is immediate and very precise. This makes it possible the operator movements to be monitored in real time with high precision.

The position correction-signal is sent for those target distance values which are shorter than a preselected distance, which obviously will depend on the currently used weapon type. This signal is with higher priority than any other message types, in order to make it possible for the immediate operator's response to be privileged. Under these conditions, the operator must position her/himself in the target provenance direction if she/he wishes to receive the other information data, because "voice" information is only supplied when the audio signal is absent.

The signal absence is identified with an angular zone further associated with the precision of the position correction which one wishes to obtain. The amplitude of this angle is variable and is linked to the discovery apparatus. When a sight discovery is carried out, it is not necessary to have a narrow zone, because human eye sight range is larger than 20°. If, on the contrary, the discovery optics is an infrared optics with a sight range of, e.g., 8°, the angular zone must necessarily be given a smaller amplitude, so as to secure that the target will be discovered.

The system, i.e., the apparatus disclosed for practicing the method according to the present invention is capable of securing, due to its positioning sensors, the G.P.S. and the Magnetic North sensor, better precision values than 5°.

In the case when a second, higher-priority target is discovered inside the engagement zone, the operator is informed of this condition, as disclosed hereinabove. In any cases, as she/he could already be in an advanced phase of engagement sequence, e.g., ready to open fire, the operator will be given the possibility of freely deciding. Obviously, under these conditions, the operator cannot change her/his target any longer, or this choice would not be advantageous.

In the case when the operator decides to change her/his target, she/he must rotate her/his head by a larger angle than 60°, during a shorter time than 2 seconds. This head rotation must be carried out within a time interval of 10 seconds from when the information was communicated.

If the operator does not succeed in performing her/his head rotation during the preestablished time, or she/he does not- accept the designation, or the conditions which determined the new designation message generation no longer exist, the operator receives an audio signal which indicates the missed acceptance of the new engagement. If the new designation message conditions continue to remain true, the new designation message will be repeated after a preestablished time, e.g., after 10 seconds.

The apparatus is furthermore capable of sending an acoustical message which indicates to the operator that not-well-identified noise is being received by radar.

The main advantage of the automatic apparatus for discovering and designating air targets is given by the possibility of transmitting to the operator all main information by means of audio signals.

Meaningful is the possibility of receiving information during target engagement, with the operator being thus supplied with a continuous updating of the target characteristics until the fire opening time has come.

Another great advantage is given by the fact that the data, transmitted as words or sound signals corresponding to the nature of the message, are ultimate and referred to the operator position, and therefore do not require that the operator perform any data analysis and cartographic activities, with consequent time losses.

We claim:

1. A method for automatically discovering and designating targets for an operator of a weapons system, comprising:

(a) automatically scanning for existence and location of a target and thereby acquiring signals indicative of existence and location of the target;

(b) transmitting signals indicative of existence and location of a target, to a portable receiver that is collocated with a weapons system operator who is wearing a headset unit which includes stereophonic headphones operatively connected with the receiver, so that the operator receives audio signals, including digitized voice signals, which vary depending on the existence and location of the target as well as on spatial orientation of the headset unit;

(c) the operator orienting his or her head towards a direction in which the weapons system is to be fired at said target by moving so as to achieve a predetermined modification of said audio signals, including digitized voice signals;

(d) while conducting steps (a) and (b), acquiring signals indicative of existence and location of a higher priority target and transmitting signals indicative of existence and location of said higher priority target to said receiver; and (e) the operator interrupting step (c) by rapid large-scale head rotation in response to audio signals received in step (d), and then conducting step (c) in regard to the audio signals received in step (d), for orienting their head towards the direction in which the weapons system is to be fired at said higher priority target.

2. The method of claim 1, wherein:

in step (c) the operator moves his or her head to minimize audio signaling to both of his or her ears.

* * * * *